US011399421B2

(12) United States Patent
Hau

(10) Patent No.: US 11,399,421 B2
(45) Date of Patent: Jul. 26, 2022

(54) UNIVERSAL DIMMER

(71) Applicant: King Kuen Hau, Hong Kong (CN)

(72) Inventor: King Kuen Hau, Hong Kong (CN)

( * ) Notice: Subject to any disclaimer, the term of this patent is extended or adjusted under 35 U.S.C. 154(b) by 0 days.

(21) Appl. No.: 17/059,245

(22) PCT Filed: May 22, 2019

(86) PCT No.: PCT/IB2019/054210
§ 371 (c)(1),
(2) Date: Nov. 26, 2020

(87) PCT Pub. No.: WO2019/229590
PCT Pub. Date: Dec. 5, 2019

(65) Prior Publication Data

US 2021/0144826 A1 May 13, 2021

Related U.S. Application Data

(60) Provisional application No. 62/677,179, filed on May 28, 2018.

(51) Int. Cl.
*H05B 45/315* (2020.01)
*H05B 39/04* (2006.01)
*H05B 39/08* (2006.01)

(52) U.S. Cl.
CPC ..... *H05B 45/315* (2020.01); *H05B 39/048* (2013.01); *H05B 39/08* (2013.01)

(58) Field of Classification Search
CPC .... H05B 45/315; H05B 39/048; H05B 39/08; Y02B 20/00
See application file for complete search history.

(56) References Cited

U.S. PATENT DOCUMENTS

2015/0366029 A1* 12/2015 Ostrovsky ..... H05B 39/041 315/224

FOREIGN PATENT DOCUMENTS

WO WO-2011114250 A1 * 9/2011 ..... H05B 33/0815
WO WO-2016016797 A2 * 2/2016 ..... H05B 39/048

* cited by examiner

*Primary Examiner* — Henry Luong

(57) ABSTRACT

Disclosed is a phase-cut dimmer, comprising an AC switch coupled in series between an AC supply and a load; a DC power supply powered from a voltage across the switch; a zero-crossing detector of a phase-cut AC voltage across the switch; a timer generating a timing signal of a duty-cycle proportional to a variable fraction of a peak voltage of a sawtooth signal, wherein the sawtooth signal is synchronized to the zero-crossing detector; a blanking signal generator triggered by a duty-cycle detector to reduce the duty-cycle when the duty-cycle of the timing signal exceeds a predetermined maximum limit; and an operation mode selector activated by an output of an inductive load detector.

28 Claims, 10 Drawing Sheets

UNIVERSAL DIMMER

BACKGROUND

Field of the Invention

The present invention is directed to phase-cut dimmers, in particular for phase-cut dimmers with low power consumption, high energy efficiency, wide dimming control range, and adaptive to different load impedances.

Description of the Related Art

Phase-cut dimmers are employed to control the amount of power delivered from an AC power supply to a lighting load. As illustrated by FIG. 1A, the dimmer DIMM is coupled in series between the AC supply VAC and the dimmer load DMLD. In this so-called two-wire configuration, the load current passes mainly through a controllable AC switch ACSW, which may be implemented by a pair of MOSFETs connected in anti-series. The AC switch may also be implemented by other semiconductor devices, such as IGBTs, triacs, etc. Note that compared to a three-wire configuration, two-wire configuration has the practical benefit of not requiring direct connection of the dimmer to both the two terminals of the AC supply, a well-received convenience for the installation work.

The dimmer works by turning on and off of the AC switch ACSW under the control of a timer TIMR through a control signal Ong. The signal Ong is a rectangular signal with a duty-cycle adjustable by a dimmer control signal Dimc which is usually a variable DC voltage, and is synchronized to the supply voltage which is usually sinusoidal. Adjustment of the duty-cycle of signal Ong leads to the dimming effect as the current through the load is therefore phase-cut by the AC switch ACSW.

Power is required to operate the timer circuit TIMR, as well as the protection circuit PROT as an almost mandatory option of a dimmer, and is supplied from a DC power supply DCPW connected in parallel with the AC switch ACSW. It can be visualized that DC supply DCPW "steals" power from the load current, when and only when the ACSW is opened. Therefore the range of dimming is limited by the amount of power required to operate the dimmer. Ideally, one would like to have a dimming range of 0% to 100%, i.e. from fully on to fully off. However, for two-wire dimmers, a 0% dimming is not possible as this means the AC switch ACSW is on all the time, implying zero voltage and hence zero power is provided to the DC power supply. On the contrary, 100% dimming is also not possible as there is always some current passing through the dimmer and hence the load DMLD which is then powered to light, even though the AC switch is kept off all the time.

Therefore any two-wire dimmer will need to be designed with a dimming range somewhere between 0% and 100%, with a sufficiently wide margin both ends to ensure proper operation. There are a few key factors to be considered, namely the power requirement of the timer circuit TIMR, power dissipation of the DC power supply DCPW, and the accuracy of timing relative to the AC cycles. The first two determines the amount of power need to be "stolen" from the load, and should be made by design as small as possible. Reducing power consumption of the dimmer is one of the most important goals of the present invention.

The accuracy of timing however relies on the timing device and hence the components thereof, such as a capacitor-resistor combination. Values of capacitor and/or the resistor may deviate from their nominal values, when manufactured or when subjected to subsequent drift in time as well as in changing environmental conditions (temperature, humidity, say). Further, to qualify a dimmer "universal", it should also be able to function well in different power line systems, such as 110V/220V and 50 Hz/60 Hz.

To cope with the above variations of operation condition, designers are forced to adopt a wide margin to each end of the dimming range, much wider than what is desirable. Dimmer products in the market are not usually specified for the dimming range, but for a dimmer controller IC it is typically specified for a dimming range of 40 degrees to 159 degrees (out of 180 degrees), i.e. 23% to 88% in duty-cycle only. This range is obviously far from the ideal range of 0% to 100%.

Even further, the operation of the dimmer is affected by the impedance nature of the load. It is well known in the prior art that a leading edge dimmer does not go well with a capacitive load, while a trailing edge dimmer does not go well with an inductive load, due to the need to switch excessively large C.dV/dt currents and L.dI/dt voltages respectively. It would be nice for a universal dimmer to be able to switch between leading edge and trailing edge modes automatically to suit the impedance nature of the load being connected.

Therefore it is most desirable to build a universal phase-cut dimmer of low power consumption, high power efficiency, wide dimming control range, and adaptive to different load impedances. These are the goals of the present invention.

The above information disclosed in this Background section is only for enhancement of understanding of the background of the invention and therefore it may contain information that does not form the prior art that is already known to a person of ordinary skill in the art.

SUMMARY OF THE INVENTION

It has been shown that both the minimum and maximum dimming capabilities of a two-wire phase-cut dimmer are dependent on the power dissipation of the dimmer itself, as compared to the minimum power of the load specified. Therefore to achieve a wide dimming range, the dimmer needs to be designed for very low power consumption, in both the DC power supply circuit and in the control circuit. Further, dimmer timing should be controlled accurately so that the DC power supply may be powered steadily by each and every half-cycle of the load current. On this target, and through the description of various embodiments of the present invention, innovative circuit arrangements are disclosed for generating a duty-cycle from a variable voltage-fraction independent of timing factors, for monitoring and limiting the duty-cycle of the switch control signal, and for automatically selecting a dimming operation mode best suiting the load being connected.

As one of the embodiments of the present invention, a phase-cut dimmer is disclosed comprising a switch coupled in series between an AC supply and a load; a DC power supply powered from a voltage across the switch; a zero-crossing detector ZDET coupled across the switch, a timer coupled across the switch, wherein the timer generates a timing signal of a variable duty-cycle in synchronization to the voltage across the switch; and a blanking (pulse) signal generator triggered by a duty-cycle detector when the duty-cycle of the timing signal exceeds a predetermined maximum limit.

For various embodiments of the present invention, the AC voltage is either chopped or phase-cut by an AC switch ACSW as shown in FIG. 1A, or by a DC switch DCSW as shown in FIG. 1B, the latter having the AC voltage rectified to a DC voltage first. Note that in either case, each of the MOSFETs is operating in the DC switching mode. Even for the case of switching AC switch ACSW, the intrinsic diode of one MOSFET acts as a rectifier offering the DC voltage for the other MOSFET. Nevertheless despite the differences in voltage rectification, the timer TIMR operates in the same way in driving the AC or the DC switch. However, the requirement for the zero-crossing detector ZDET will be different for detection under an AC or a DC (pulsating) voltage across the AC or DC switch respectively.

Briefly for the AC switching mode as shown in FIG. 2A, the AC voltage across the AC switch ACSW, i.e. between terminals T1 and T2, is greatly amplified by a comparator COMP1 to become a square signal Sgsq, the rising and falling edges of which are detected by an edge detector EDET to give a zero-crossing pulse signal Sgz.

As for DC switching mode typically as shown in FIG. 3A, the pulsating DC signal from terminal T1 is compared to a low voltage threshold Vth substantially close to zero, generating a pulse when the DC signal falls below the threshold. Note however, due to the accumulation of charge on the parasitic capacitance at terminal T1 that might stop the voltage falling below the threshold Vth, a voltage controllable bleeder CBLD is installed parallel to the DC switch DCSW.

As another embodiment of the present invention, a phase-cut dimmer is disclosed comprising a switch coupled in series between an AC supply and a load; a DC power supply powered from a voltage across the switch; a zero-crossing detector ZDET coupled across the switch, a timer generating a timing signal of a duty-cycle proportional to a variable fraction of a peak voltage of a sawtooth signal, wherein the sawtooth signal is synchronized to the voltage across the switch.

Yet as another one of the embodiments of the present invention, a phase-cut dimmer is disclosed comprising a switch coupled in series between an AC supply and a load; a DC power supply powered from a voltage across the switch; a zero-crossing detector ZDET coupled across the switch, a timer generating a timing signal of a duty-cycle proportional to a variable fraction of a peak voltage of a sawtooth signal, wherein the sawtooth signal is synchronized to the voltage across the switch; and a blanking signal generator triggered by a duty-cycle detector when the duty-cycle of the timing signal exceeds a predetermined maximum limit.

Yet as another embodiment of the present invention, a phase-cut dimmer is disclosed comprising a switch coupled in series between an AC supply and a load; a DC power supply powered from a voltage across the switch; a zero-crossing detector ZDET coupled across the switch, a timer generating a timing signal of a duty-cycle proportional to a variable fraction of a peak voltage of a sawtooth signal, wherein the sawtooth signal is synchronized to the voltage across the switch; and a blanking signal generator triggered by a voltage detector monitoring a voltage of the DC power supply.

Yet as another embodiment of the present invention, a phase-cut dimmer is disclosed comprising a switch coupled in series between an AC supply and a load; a DC power supply powered from a voltage across the switch; a zero-crossing detector ZDET coupled across the switch, a timer generating a timing signal of a duty-cycle proportional to a variable fraction of a peak voltage of a sawtooth signal, wherein the sawtooth signal is synchronized to the voltage across the switch; a blanking signal generator triggered by a voltage detector monitoring a voltage of the DC power supply; and an operation mode selector activated by an output of an inductor load detector.

For a timing signal of a duty-cycle proportional to a variable fraction of a peak voltage of a sawtooth signal, a generator circuit of the signal is disclosed, comprising a sawtooth signal generator synchronized to the zero-crossing detector; a peak detector, a potentiometer (generally a means to obtain a fraction of a voltage) and a comparator, wherein the peak voltage of the sawtooth signal being detected as a DC voltage, a fraction of the DC voltage as tapped from the potentiometer being compared to the sawtooth signal, whereby the output of the comparator bears a duty-cycle proportional to the fraction of the tapped voltage to the peak voltage of the sawtooth signal.

As another embodiment of the present invention, a phase cut dimmer with automatic dimming operation mode selection is disclosed, comprising a monotonic phase detector by which the impedance nature of the load is determined for selecting a preferred mode of operation.

BRIEF DESCRIPTION OF THE DRAWINGS

With the foregoing in view, as other advantages as will become apparent to those skilled in the art to which this invention relates as this patent specification proceeds, the invention is herein described by reference to the accompanying drawings forming a part hereof, which includes descriptions of some typical preferred embodiments of the principles of the present invention, in which.

DETAILED DESCRIPTION OF THE INVENTION

Figure 1A:
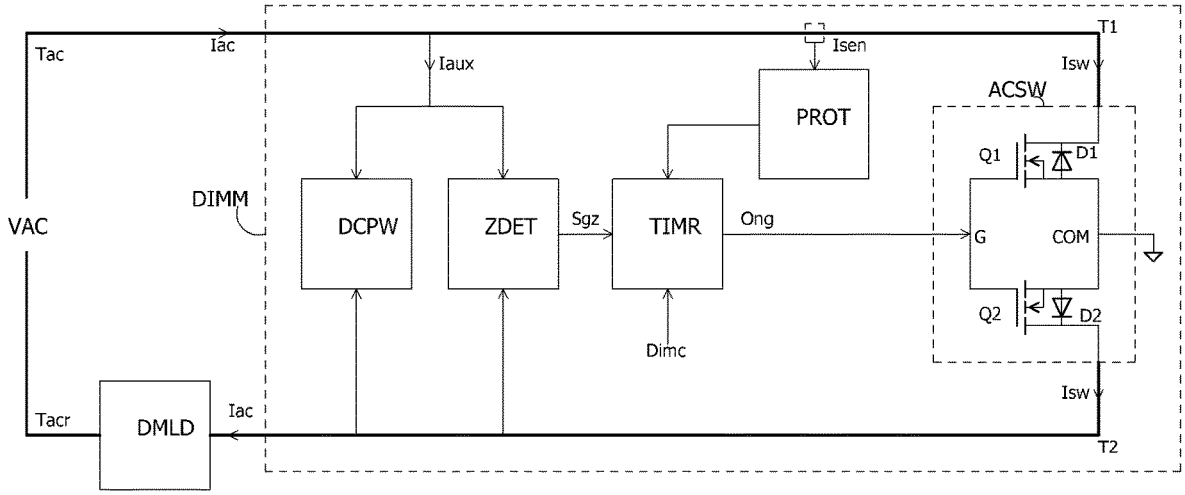
Fig. 1A Prior Art
FIG. 1A A phase-cut dimmer by an AC switch (Prior art)
Figure 2A:
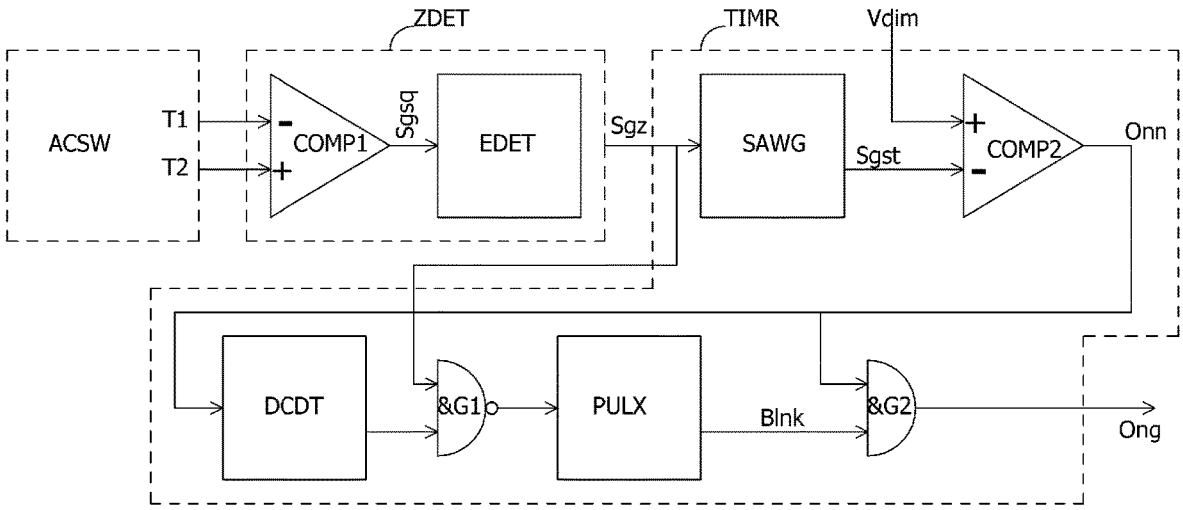
FIG. 2A A trailing edge dimmer as an embodiment of the present invention
Figure 2B:
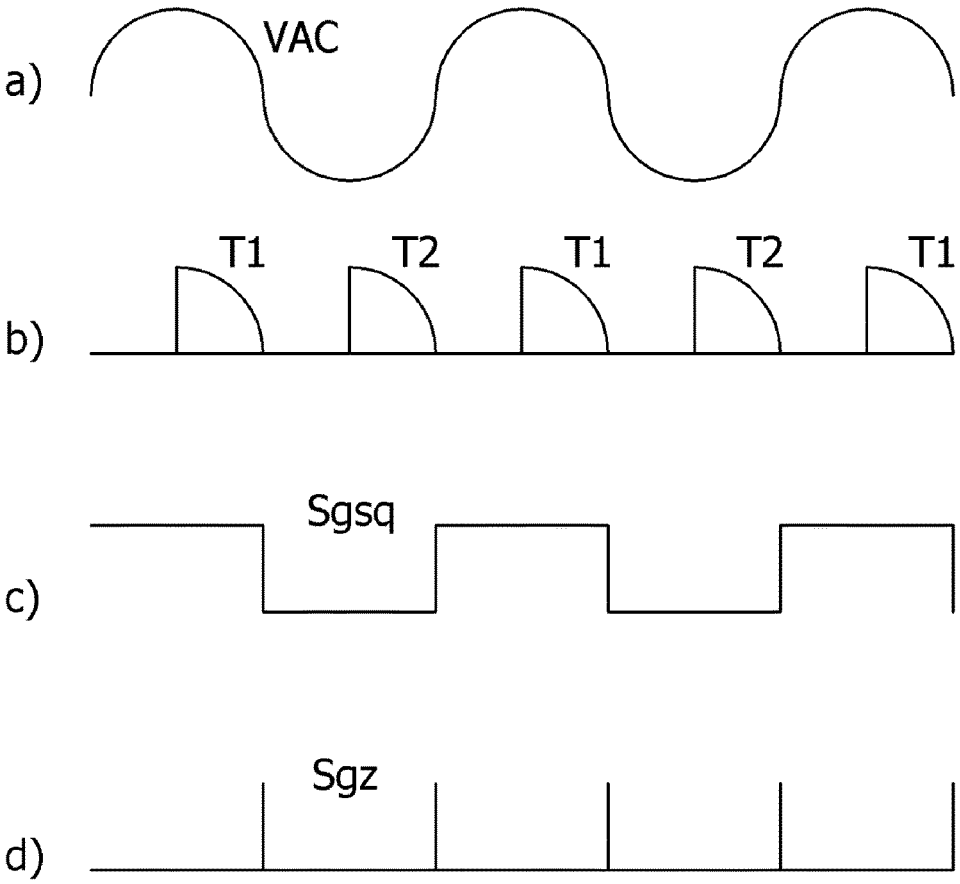
FIG. 2B Waveform diagram of a zero-crossing detector for AC voltage

Accuracy in timing of the phase cut dimmer is crucial to the performance of the dimmer. As the timer is conveniently synchronized to the zero-crossing of the AC supply voltage, accurate detection of the zero-crossing is essential for the dimmer. Referring to FIG. 2A, for the zero-crossing detector ZDET, the voltages at the two drain terminals T1 and T2 of the MOSFET AC switch ACSW (as already described with reference to FIG. 1A) are compared by comparator COMP1, output of which is a precise square signal Sgsq. By the edge detector EDET signal Sgz is generated with a positive pulse at each zero-crossing of the AC voltage across the AC switch. The waveforms are as shown in FIG. 2B. Signal waveform a) is the AC supply voltage VAC, b) is voltages at the terminal T1 and T2 shown chopped by around 90 degrees in trailing edge mode. Note that the voltage of T1 or T2 is the drain voltage of the respective MOSFET as shown in FIG. 1A. When the ACSW is not conducting, both Q1 and Q2 are off, voltages at T1 and T2 are high and of opposite polarities with respect to the common source or the ground. When the ACSW is conducting, both Q1 and Q2 are conducting and voltages at T1 and T2 are only of low voltage across the MOSFETs. The magnitude of voltage drop depends on the load current flowing through and the channel resistance of the respective MOSFET, plus any source resistance connected between the source terminal and the common ground (not used in the ACSW circuit of FIG. 1A). Nevertheless it can be visualized that the voltage polarities at T1 and T2 are always opposite to each other, whether the MOSFETs are on or off. Therefore a square waveform c) Sgsq is generated from comparison of voltages at T1 and T2 with each other by comparator COMP1. Through the edge detector EDET, signal Sgsq is differentiated and rectified to give the positive zero-crossing pulses Sgz as waveform d).

Synchronized to the zero-crossing signal Sgz a sawtooth wave Sgst is generated by the generator SAWG. The sawtooth is compared by comparator COMP2 to a variable voltage Vdim. The output of COMP2 is a pulse signal Onn with duty-cycle proportional to the voltage Vdim. By adjusting the voltage Vdim, the duty-cycle can be varied from zero to 100%.

However there is a problem when the duty-cycle is 100% or close to 100%, meaning that the ACSW is switched on all the time or nearly all the time. There is no or little time that the switch is open to supply power to the DC power supply DCPW. Consequently, the dimmer will not work properly. Therefore, in practice, and to allow for normal variations of the circuit components (in the timing circuit in particular), say 90% say is designed as the maximum of the adjustable dimming range. The dimming range is thus limited by the output power of the dimmed load, a situation not desirable if the load is small, and is to be improved by the present invention.

The improvement is through a blanking (pulse) signal Blnk of sufficient width to reduce the duty-cycle once the duty-cycle of Onn is close to 100%, generating the pulse Ong by an AND gate & G2, which will be coupled to control the MOSFET AC switch ACSW. As shown in the FIG. 2A, signal Onn is coupled to the duty-cycle detector DCDT which outputs a high signal only when the duty-cycle of Onn exceeds a preset level close to 100%, say 98%. By the NAND gate & G1 this high signal will enable the zero-crossing pulse from EDET to be inverted and extended by a pulse extender PULX to generate the blanking signal Blnk of a predetermined pulse width of say 200 us. Therefore over each and every half cycle, at least for 200 us the ACSW is opened to allow the dimmer control circuit to obtain the necessary power. This is guaranteed irrespective of the variation of the timing circuit.

Figure 3A:
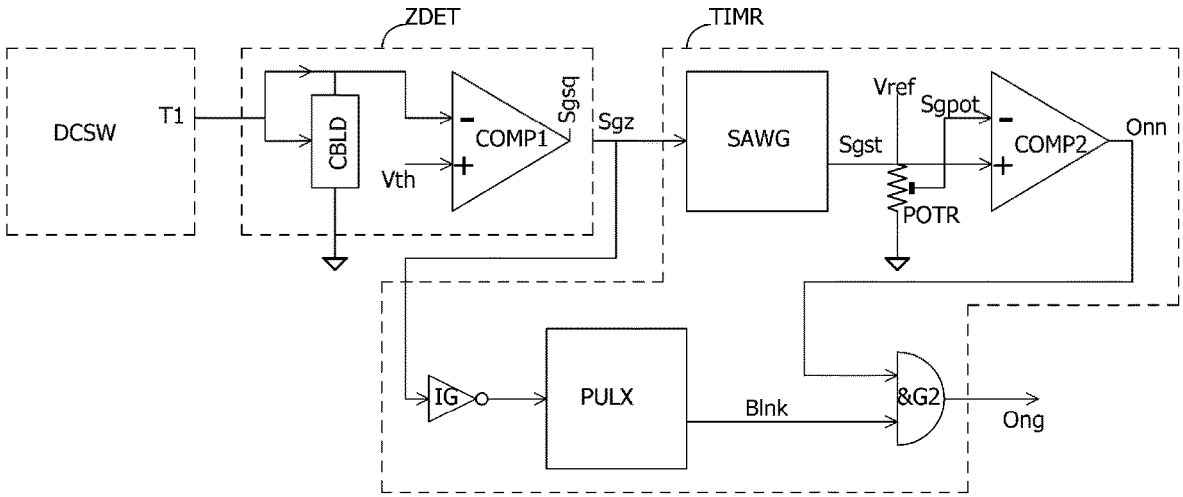
FIG. 3A A leading edge dimmer as an embodiment of the present invention

As another embodiment of the present invention, a leading edge dimmer is shown in FIG. 3A. Instead of using an AC switch a DC switch DCSW is deployed, setting an example typical of this kind. A very different design of zero-crossing detection is required. The pulsating DC signal from terminal T1 is compared to a low voltage threshold Vth substantially close to zero, generating a pulse when the DC signal falls below the threshold. Note however, due to the accumulation of charge on the parasitic capacitance at terminal T1 that might stop the voltage falling below the threshold Vth, a controllable bleeder CBLD is installed.

Figure 3B:
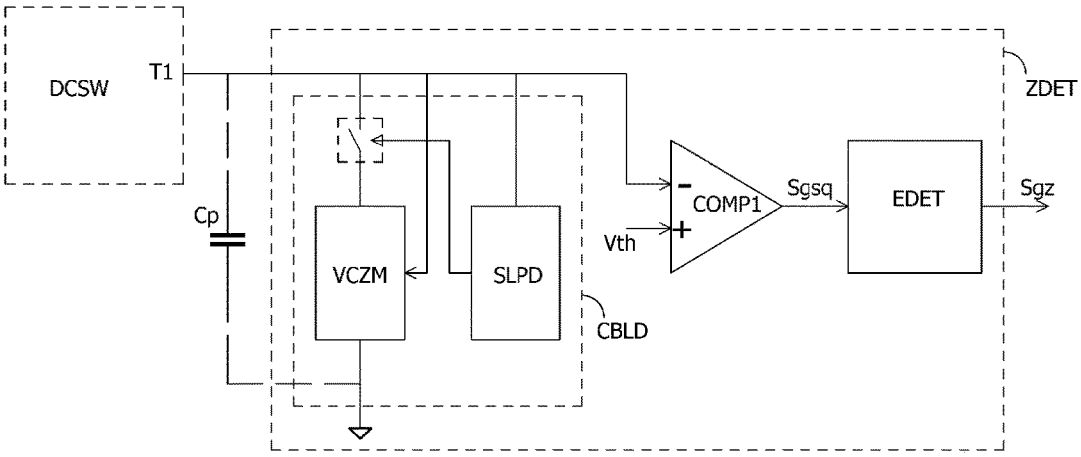
FIG. 3B Zero-crossing detector for rectified AC voltage

For more details of a zero-crossing detector as an embodiment of the present invention, please refer to FIG. 3B. As shown, the controllable bleeder is comprising a voltage controlled impedance module VCZM, coupled to the terminal T1 through a bleeder switch Sb, in parallel with the parasitic capacitor Cp. The impedance of the module is designed to be controlled by the input voltage, i.e. the terminal voltage at T1. The goal is to discharge the parasitic capacitor Cp during the falling edge of the terminal voltage so that the "zero-crossing" is "unburied" from the residue charge in the parasitic capacitor. However, bleeding dissipates power. Therefore it is not wise to have the impedance of the module lower than necessary for zero-crossing detection. A good practice is to control the impedance from high to low as the voltage goes from high to low, such as for the case of a constant current sink, keeping relatively a lower power of dissipation. On the other hand, the bleeder impedance dissipates power also on the rise of the voltage, but this makes no contribution to zero-crossing detection. To reduce power dissipation (to almost a half) the switch Sb is opened during the rising edge of the terminal voltage, as detected by the voltage slope detector SLPD. Only when a falling edge is detected, switch Sb is closed to complete the bleeding path.

Figure 3C:
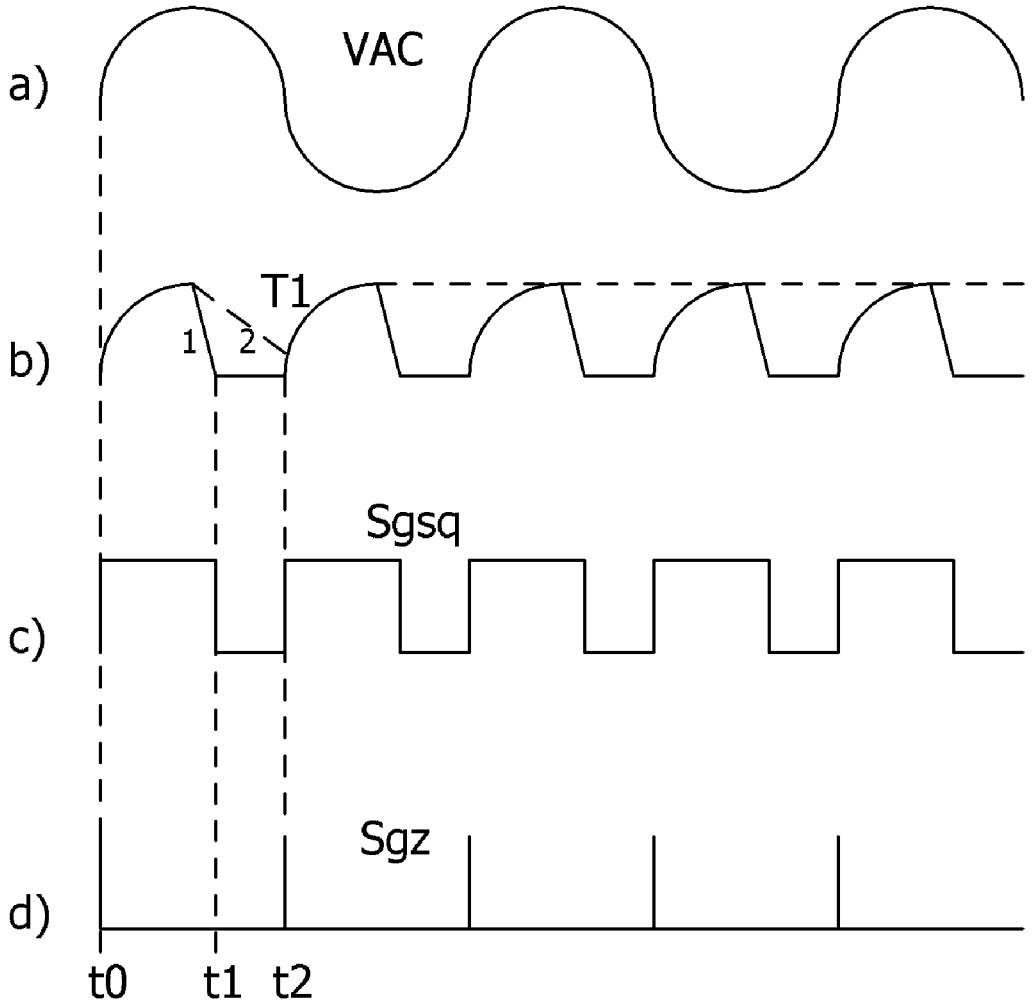
FIG. 3C Waveform diagram of a zero-crossing detector for rectified AC voltage FIG. 4A A voltage-fraction to duty-cycle converter deploying a peak detector as an embodiment of the present invention FIG. 4B A voltage-fraction to duty-cycle converter deploying sample and hold as an embodiment of the present invention FIG. 4C Waveform diagram for the voltage-fraction to duty-cycle converter FIG. 5 A dimmer with voltage-fraction to duty-cycle converter FIG. 6 A dimmer with adaptive blanking by duty-cycle detection FIG. 7 A dimmer with adaptive blanking by duty-cycle detection through DC power supply FIG. 8B An inductor load detector (Prior art)

FIG. 3C shows the waveforms of the zero-crossing bleeder as described above, for rectified AC voltage. Signal waveform a) is the AC supply voltage VAC, b) is waveform of voltage at the terminal T1 shown chopped by around 90 degrees in forward edge mode. Note during time t1 and t2, the terminal voltage falls along two possible paths 1 and 2, path 1 has obviously a more effective bleeding than path 2. By path 2, the terminal voltage has not fallen low enough by t2 such that detection of zero-crossing fails. Consequently phase cut dimming fails and voltage at T1 stays high as shown by the dotted line of path 2. On the other hand, bleeding is effective for path 1, leading to the generation of the square signal Sgsq as waveform c) from comparator COMP1 by comparison of the terminal voltage at T1 with a predetermined threshold Vth. By differentiation of the signal Sgsq by an edge detector EDET, zero-crossing signal Sgz is generated as positive pulses of waveform d).

Apart from the differences in zero-crossing detection, FIG. 3A differs from FIG. 2A that Sgpot has replaced Vdim just to show one way to obtain a variable dimming control voltage, i.e. tapping a fraction of the reference voltage Vref by a potentiometer POTR. By looking at this arrangement, one may visualize that if we replace Vref by a DC voltage equal to the peak of the sawtooth signal Vgst, Sgpot can be adjusted by the potentiometer from zero to the peak of the sawtooth signal, for which a duty-cycle of the output Onn from comparator COMP2 will be matched exactly from zero to 100%!

Figure 4A:
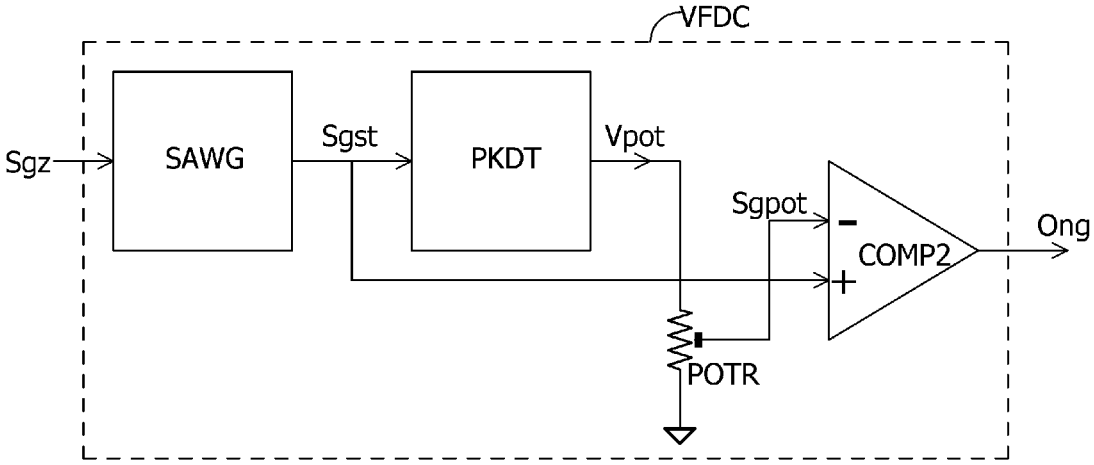

Calling this innovative circuit a Voltage-Fraction to Duty-Cycle Converter, VFDC as an embodiment of the present invention, the operation principle is illustrated by FIG. 4A. As shown, a sawtooth signal Sgst is generated by the generator SAWG in synchronization to the zero-crossing signal Sgz. A peak detector PKDT detects the peak of Sgst as a DC voltage Vpot, which is applied to the potentiometer POTR. A tapped voltage Sgpot from POTR is compared to the sawtooth signal Sgst by COMP2, generating a signal Ong with a duty-cycle equal to the tapped fraction of the potentiometer POTR.

Figure 4B:
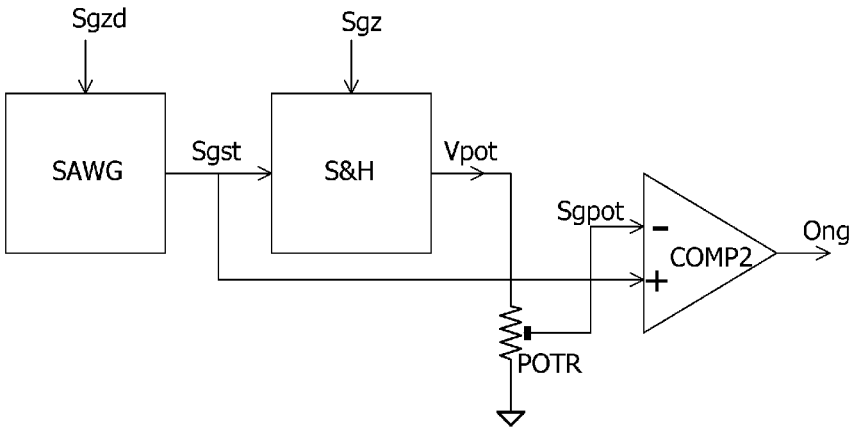
Figure 4C:
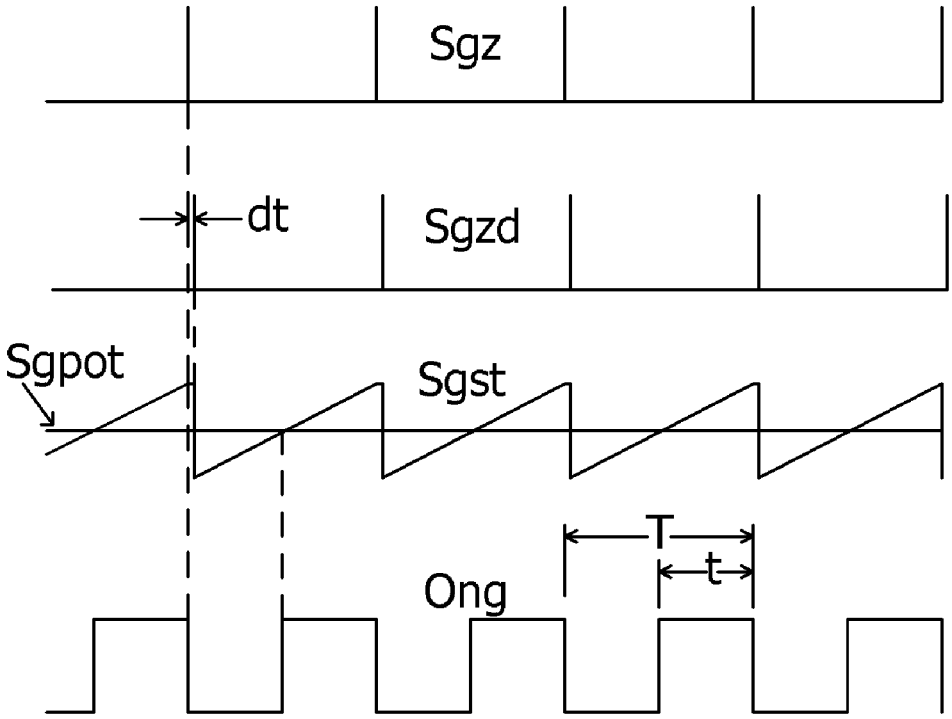

A special way of peak detection is by sample and hold at the peak of the sawtooth signal Sgst, the operation principle as illustrated by FIG. 4B. As shown, sample and hold circuit S&H and the sawtooth generator SAWG are triggered by signal Sgzd and Sgz respectively, where Sgzd is slightly delayed from Sgz. This is to make sure that signal sampling is completed before the sawtooth generator is reset for the next cycle. As shown by the waveforms of FIG. 4C, Sgzd is delayed from Sgz by dt, i.e. the sawtooth generator is reset a time dt later than the zero-crossing Sgz, when voltage sampling is made.

Note that although sawtooth signal is deployed for the Voltage-Fraction to Duty-Cycle Converter VFDC, any ramping signal can be used instead as long as ramping is monotonic between a low and a high voltage.

Figure 5:
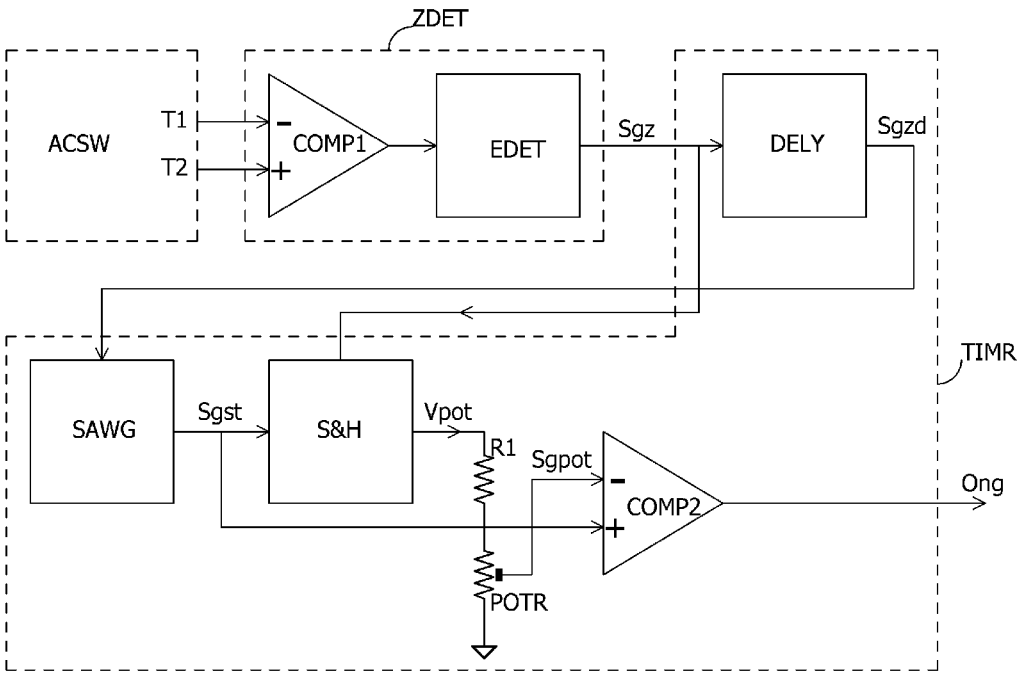

The use of a Voltage-Fraction to Duty-Cycle Converter, VFDC is demonstrated in FIG. 5. Basically VFDC is deployed as a dimming timer TIMR. Zero-crossing signal Sgz is delayed by delay module DELY to form the signal Sgzd. Note a resistor R1 is put in series with the potentiometer POTR, limiting the adjustment range of the potentiometer, hence the dimming range, to a value less than 100%.

Figure 6:
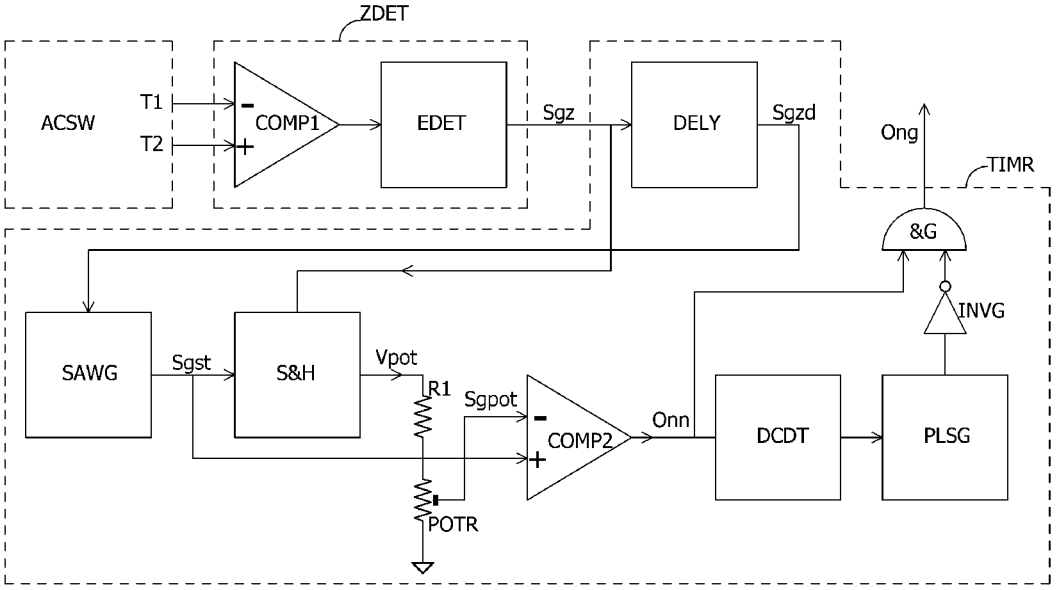

In FIG. 6, Voltage-Fraction to Duty-Cycle Converter, VFDC is deployed in a phase cut dimmer, with the blanking control by duty-cycle detection as described with reference to FIG. 2A.

Figure 1B:
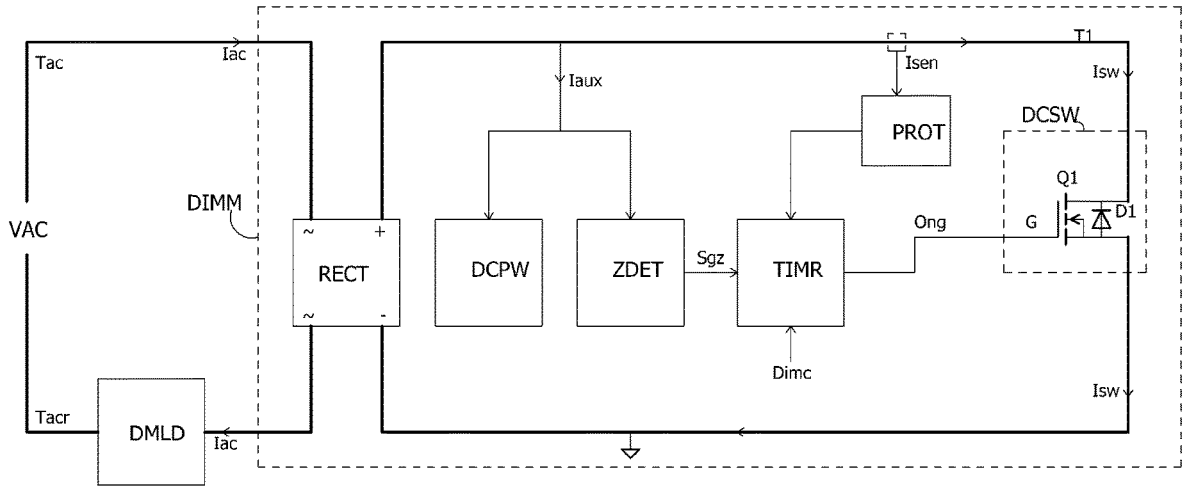
Fig. 1B Prior Art
FIG. 1B A phase-cut dimmer by a DC switch (Prior art)
Figure 7:
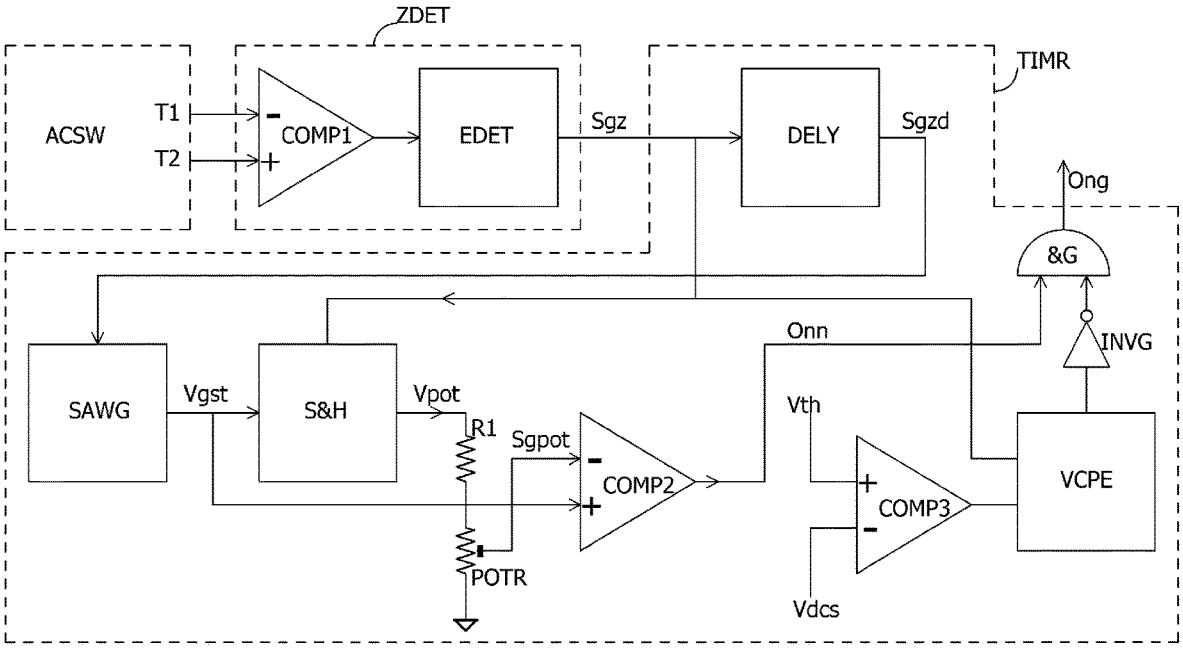

In FIG. 7, shown is a timer with blanking control based on the need to power up the DC power supply. As shown, a voltage Vdcs from the DC power supply (DCPW of FIGS. 1A and 1B) is compared to a predetermined threshold voltage Vth. Should the dimming is too low i.e. when the duty-cycle is too close to 100%, Vdcs will fall below Vth, the output from COMP3 will go high. Therefore the detection of the voltage Vdcs, or in general an average voltage of at least one terminal of the switch, may be deployed to reveal the situation that the duty-cycle is close to 100%. The detector output, i.e. output from COMP3 will drive the voltage controlled pulse extender VCPE to extend the pulse width of zero-crossing signal Sgz, which is then inverted to act as a blanking signal to the MOSFET gate drive Ong. The extended blanking will effectively reduce the duty-cycle just enough to raise Vdcs to a value to ensure that the DC power supply is sufficiently powered in good operation condition.

Figure 8A:
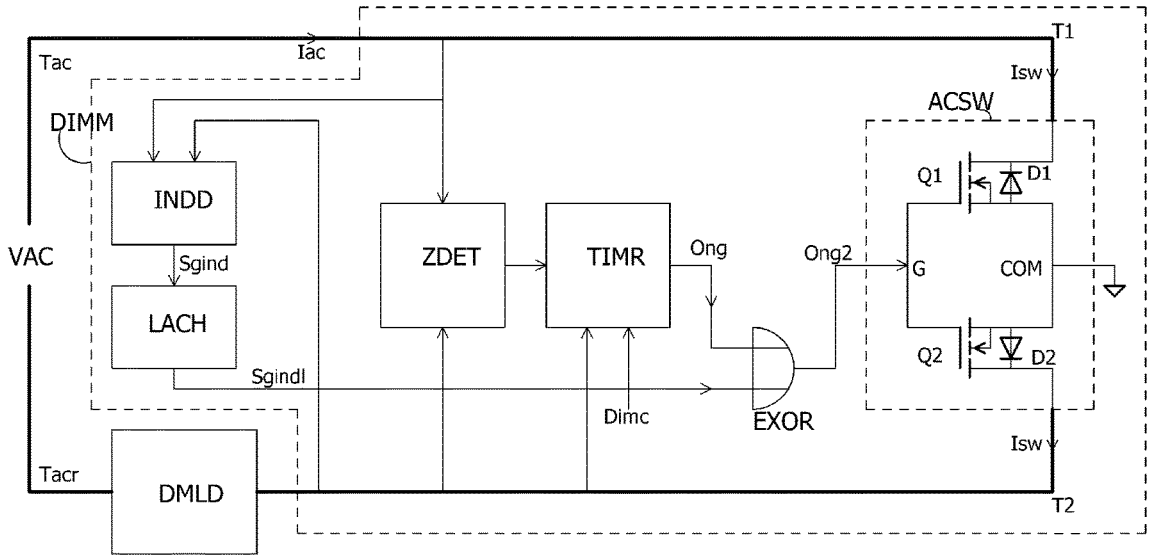
FIG. 8C An inductor load detector as an embodiment of the present invention

FIG. 8A shows the operation principle of an automatic mode selectable dimmer. For ease of illustration, the DC power supply, the blanking circuit and the protection circuit are omitted from the diagram. An Exclusive-OR gate is deployed to control the polarity of the gate drive signal Ong before applying as Ong2 to the control gate G of the switch ACSW. When the input signal Sgind1 is low, Ong2 has the same logic level of Ong; when Sgind1 is high, Ong2 has an inverted logic level of Ong. Hence by simply controlling the logic polarity of the input Ong2 to the gate of the switch, leading/trailing edge mode can be selected, a merit of the present invention. As shown, signal Sgind1 is a latched signal of an output from an inductor load detector INDD, indicating if the load is an inductive one. Detection takes place when the dimmer is powered up in a trailing edge mode, when the latch LACH is reset to have signal Sgind1 low. Should the load is inductive, high voltage overshoot and ringing will be developed across the dimmer switch, ACSW (see FIG. 2A) or DCSW (see FIG. 3A) as may have been used. The output of INDD will be a positive pulse that triggers to latch a high signal of Sgind1 to invert the gate drive signal Ong to Ong2, and the dimmer is thus logged to the leading edge mode as long as power is maintained for the dimmer.

Figure 8B:
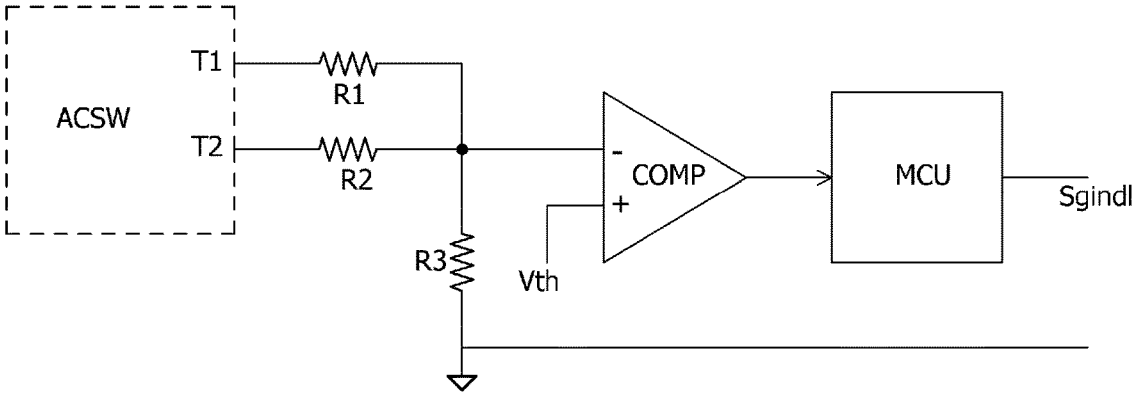
Fig. 8B Prior Art

The operation principle of an inductor load detector can be explained with reference to FIG. 8B. The high voltage signals from the terminals T1 and T2 of the AC switch ACSW (see FIG. 2A) are scaled down by resistors R1, R2 and R3 (or just T1 without the use of R2 in the case of DC switch DCSW, see FIG. 3A). The scaled down voltage is compared to a threshold voltage Vth by a comparator COMP, which acts as a voltage discriminator by which only ringing peaks of magnitude greater than Vth will be passed to a microcontroller unit MCU, or generally a counting means. By counting the number of pulses within a portion of the AC switch cycle (10 ms for the 50 Hz mains), an algorithm run by the MCU will determine if the load should be classified as inductive. This has been disclosed in the prior art such as United States patent US523925. Thus by a digital output Sgind1 from the MCU indicating the presence of an inductive load, the dimmer can be switched from a trailing edge mode to a leading edge mode accordingly.

Figure 8C:
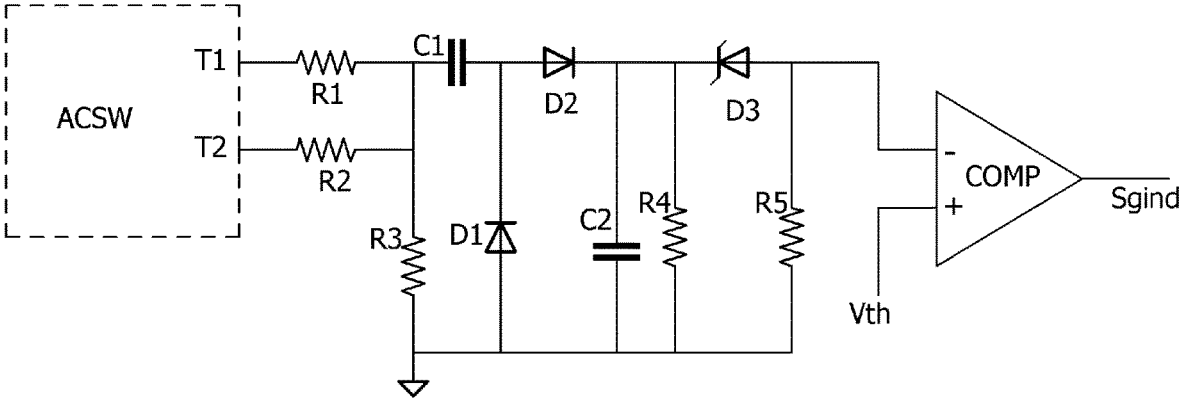

As an embodiment of the present invention, an analog circuit equivalent of an inductive load detector is now disclosed with reference to FIG. 8C. As shown, the high voltage signals from the terminals T1 and T2 of the AC switch ACSW (see FIG. 2A) are scaled down by resistors R1, R2 and R3 (or just T1 without the use of R2 in the case of DC switch DCSW, see FIG. 3A), and then coupled to a charge pump comprising capacitors C1 and C2, and diodes D1 and D2. With a suitable ratio of capacitor values of C1 and C2, the charge pump works as a pulse counter such that the output voltage across the capacitor C2 will rise with increasing number of pulses within a predetermined time period (a portion of the AC switch cycle), to a value also determined by a resistor R4 which acts to bleed off the charge on C2 during the charging period. The output of the charge pump is coupled to a comparator COMP through a Zener diode D3, effectively preventing any voltage lower than the Zener voltage to be coupled to the comparator. Any output voltage in excess of the Zener voltage, due to switching of an inductive load, is then compared to a threshold voltage Vth by the comparator COMP, the output of which as signal Sgind will change state and be latched as Sgind1 for control of the operation mode of the dimmer. Further, with a combined impedance of D1, D2, D3, C4, R4 and R5, value of C1 may be chosen sufficiently low to form a high-pass filter so that only ringing voltage due to switched inductive load can pass but not the line frequency phase-cut voltage across the switch.

Figure 9A:
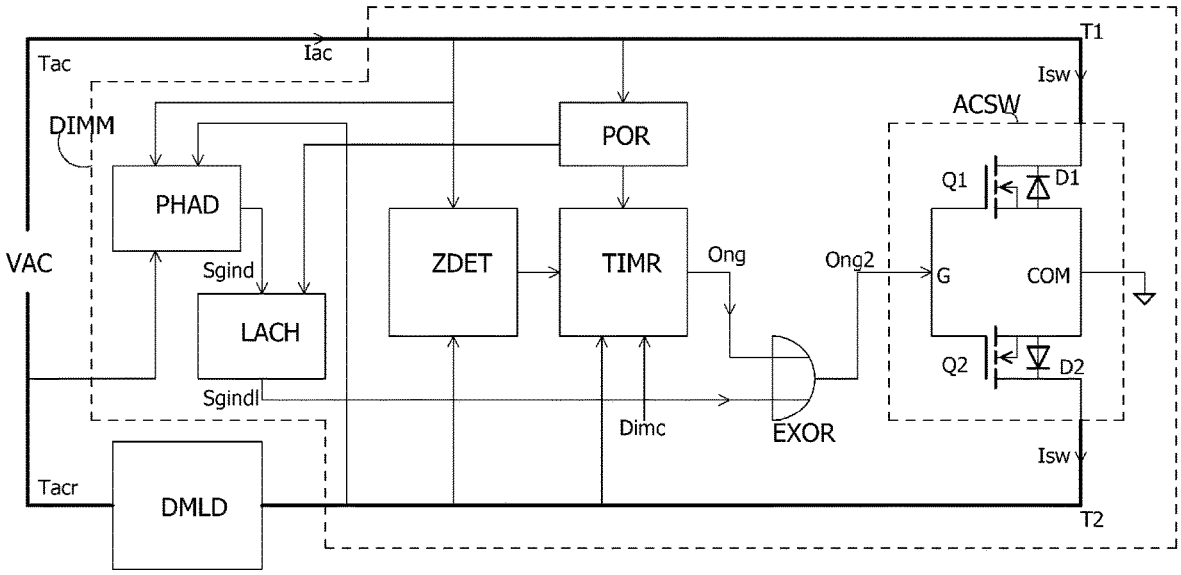
FIG. 9A A universal dimmer with automatic mode selection by phase detection

Alternatively inductive load may be detected by the fact that an inductive (capacitive) load current lags (leads) the applied AC voltage. In other words, if we can determine the phase angle of the load current relative to the applied AC voltage, we can tell whether the load impedance is inductive or capacitive, when the load current is lagging or leading respectively. As shown in FIG. 9A, a phase detector PHAD is deployed to determine the relative phase angle between the voltages at the two terminals of the load, i.e. those at the terminals Tacr and T2 respectively, both with reference to T1. Note that as far as phase angle is concerned, the voltage between terminals Tacr and T1 is the applied AC voltage, while that between T2 and T1 is representative of the load current while the AC switch ACSW is conducting. In this regard, in order to have a continuous load current during the period of inductive load detection, the dimmer should be forced to a zero dimming state. This is best done during power-on reset. As shown, a power-on reset circuit POR is made to turn switch signal Ong on continuously from the timer TIMR, irrespective of the state of dimming control signal Dimc. A single pulse signal from POR resets the latch circuit LACH, before the phase detector PHAD starts to operate during a predetermined short power-on reset period.

Figure 9B:
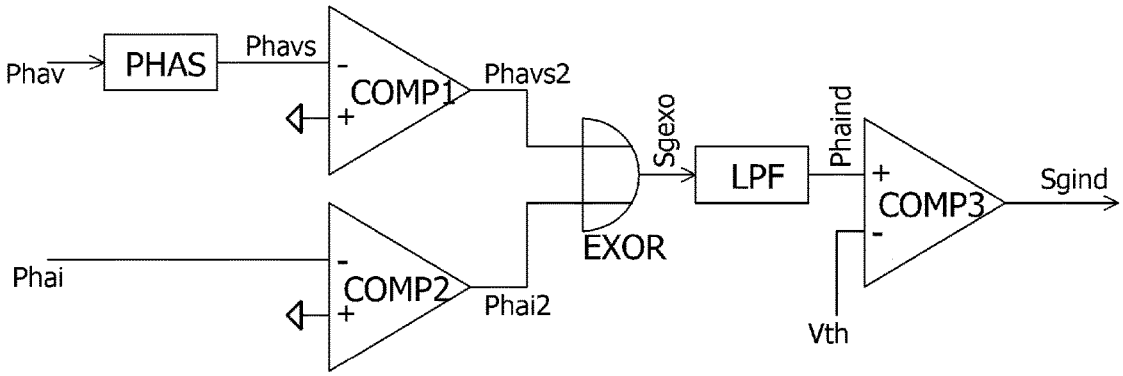
FIG. 9B A phase detector for load impedance detection

Phase detector PHAD may be implemented according to the block diagram of FIG. 9B. As shown, a signal Phav representative of the phase of the applied AC voltage is coupled to a phase shifter PHAS, delaying the phase by 90 degrees to a signal Phays. This, and another signal Phai representative of the phase of the load current, are converted by the comparators COMP1 and COMP2 respectively to square signals Phays2 and Phai2. Then by an Exclusive-OR gate EXOR a signal Sgexo representative of the phase difference between the signals Phays2 and Phai2 is generated. By a low pass filter LPF the signal Sgexo is converted to a DC signal Phaind representative of the phase difference between the applied AC voltage and the load current. The operation principle may be further explained with reference to the waveform diagrams FIG. 9C.

Figure 9C:
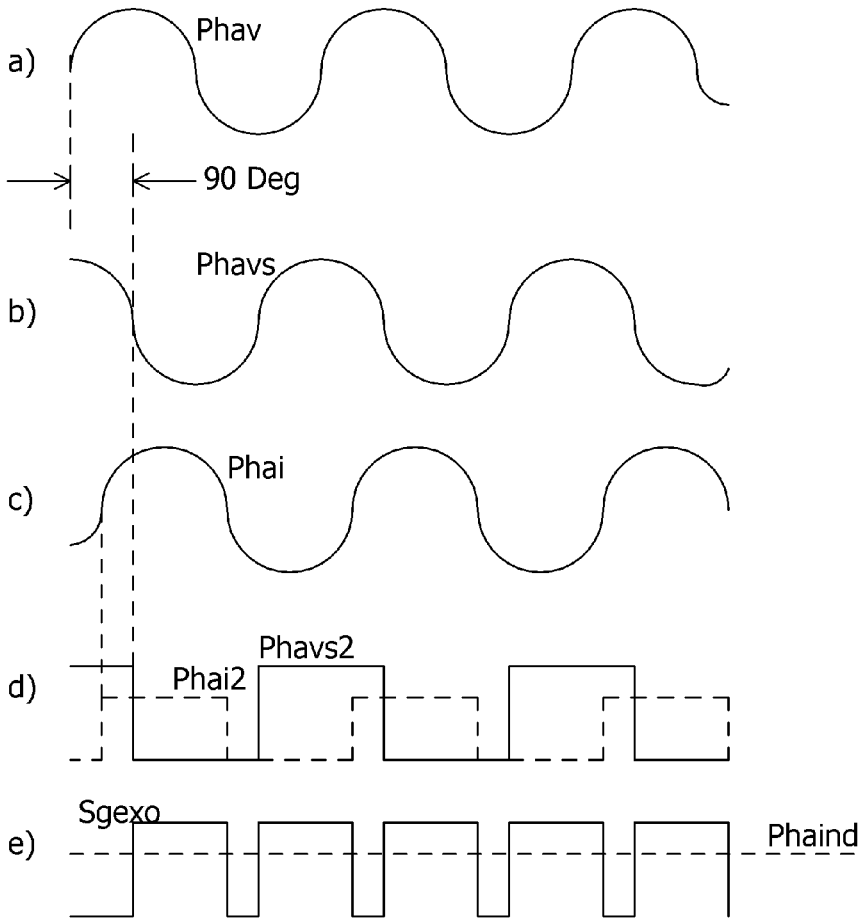
FIG. 9C Waveform diagram of the phase detector

As shown, waveform a) Phav representative of the applied AC voltage is phase delayed by 90 degrees to waveform b) as Phays. Waveform c) Phai is representative of the load current. Now it is well known that for an inductive load Phai will be phase lagging Phav while for a capacitive load Phai will be phase leading Phay. The phase difference of the load current from the applied AC voltage spans from −90 degrees to +90 degrees as the load impedance varies from pure capacitive to pure inductive. However it is also well known that an Exclusive-OR phase detector is only monotonic from 0 to 180 degrees or from 180 to 360 degrees. Therefore by phase delaying Phav by 90 degrees to Phays, we have the phase difference of Phai2 from Phays2 spanning from 0 to 180 degrees, corresponding to a pure capacitive load to a pure inductive load, monotonic in the range. In other words, the DC signal Phaind indicates a shift of capacitive to inductive of the load as the voltage shifts from low to high. Referring to FIG. 9C, the phase difference of Phai2 and Phays2 shown as waveform d) is detected by the Exclusive-OR gate EXOR as signal Sgexo, shown as waveform e). The signal Phaind, a DC equivalent of Sgexo, is obtained through a low pass filter LPF as shown in FIG. 9B. Comparing Phaind to a preset threshold voltage Vth by comparator COMP3, a signal Sgind is generated indicative whether the load is classified as inductive or not.

Although the invention and its advantages have been described in detail, it should be understood that various changes, substitutions, and alterations can be made therein without departing from the spirit and scope of the invention as described. For example, the specific implementation of the inventive circuits may be varied from the examples provided herein while still within the scope of the present invention. As some more examples, specified directions of current flow, polarities of the voltages may be reversed, the polarities or electrodes of a semiconductor device may be interchanged, voltage and current levels may be scaled or shifted up or down. Further, by the duality property of electrical circuits, the roles of current and voltage, impedance and admittance, inductance and capacitance, etc., can be interchanged. In essence, the discussion included in this application is intended to serve as a basic description. It should be understood that the specific discussion may not explicitly describe all embodiments possible; many alternatives are implicit. It also may not fully explain the generic nature of the invention and may not explicitly show how each feature or element can actually be representative of a broader function or of a great variety of alternative or equivalent elements. Again, these are implicitly included in this disclosure. Where the invention is described in device-oriented terminology, each element of the device implicitly performs a function. Neither the description nor the terminology is intended to limit the scope of the invention.

The invention claimed is:

1. A phase-cut dimmer coupled between an AC supply and a load, comprising:

a switch coupled in series between the AC supply and the load;

a timer generating a timing signal of a preselected duty-cycle to turn on and to turn off the switch at the duty-cycle;

an independent duty-cycle detector monitoring the duty-cycle of the timing signal from the timer;

wherein the timing signal is synchronized to the AC supply; and wherein the duty-cycle is controlled by an output of the duty-cycle detector to stay under a predetermined maximum limit.

2. The dimmer of claim 1, wherein the duty-cycle detector is a voltage detector monitoring an average voltage of at least one terminal of the switch.

3. The dimmer of claim 1, further comprising a zero-crossing detector through which the timing signal is synchronized to the AC supply.

4. The dimmer of claim 2, wherein the reaching of the duty-cycle to the maximum limit is detected by a fall of the average voltage below a predetermined minimum limit.

5. The dimmer of claim 1, wherein the timer is a voltage-fraction to duty-cycle converter.

6. The dimmer of claim 1, wherein the switch is an AC semiconductor switch.

7. The dimmer of claim 6, wherein the AC semiconductor switch is comprising a pair of MOSFETs connected in anti-series.

8. The dimmer of claim 5, wherein the voltage-fraction to duty-cycle converter is comprising:

a sawtooth signal generator;

a peak detector which detects a peak voltage of the sawtooth signal;

a voltage divider to generate a fraction of the peak voltage;

a comparator to compare the fraction of the peak voltage to the sawtooth signal;

whereby the output signal of the comparator has a duty-cycle equal to the fraction.

9. The dimmer of claim 8, wherein the peak detector is comprising a sample-and-hold circuit, whereby the sawtooth signal is sampled at the peak.

10. The dimmer of claim 8, wherein the voltage divider is a potentiometer.

11. The dimmer of claim 1, further comprising a blanking pulse generator triggered by the duty-cycle detector to reduce the duty-cycle.

12. The dimmer of claim 1, further comprising an inductive load detector and an operation mode selector, wherein the detector is coupled to at least a first terminal of the switch, whereby a leading or a trailing edge operation mode of dimming is selected according to the output of the detector.

13. The dimmer of claim 12, wherein the inductive load detector is comprising:

a first signal detector of a voltage across the load;

a second signal detector of a current through the load;

a phase-shifter; and a phase detector; wherein:

the first signal is phase-shifted by 90 degrees to a third signal;

a phase difference between the second and the third signal is detected by the phase detector;

whereby the phase difference is indicative of an inductive load.

14. The dimmer of claim 13, wherein the phase detector is comprising:

a first comparator for comparison with a zero reference;

a second comparator for comparison with the zero reference;

a logical exclusive-OR circuit; and a low-pass filter;

wherein:

the second signal is converted to a first digital signal by the first comparator; and the third signal is converted to a second digital signal by the second comparator;

a logical exclusive-OR function of the first and the second digital signals is coupled to a low-pass filter; wherein the output of the filter is indicative of the phase difference.

15. The dimmer of claim 12, wherein the inductive load detector is comprising a high-pass filter and a charge pump coupled in cascade, whereby an output of the charge pump is indicative of an inductive load.

16. The dimmer of claim 3, A wherein the zero-crossing detector is comprising:

a voltage comparator comparing a first voltage of a first terminal of the switch to a second voltage of a second terminal of the switch;

an edge detector coupled to the output of the comparator and responding to both the rising and the falling edges of the output of the comparator;

whereby a zero-crossing pulse signal is generated by the edge detector.

17. A method of phase-cut dimming for controlling power delivered from an AC supply to a load, comprising the steps of:

coupling the AC supply to the load through a switch;

generating a timing signal of a preselected duty-cycle in synchronization to a zero-crossing signal of the AC supply;

monitoring the duty-cycle of the timing signal from the timer by an independent duty-cycle detector;

controlling the duty-cycle of the timing signal by an output of the duty-cycle detector to stay under a predetermined maximum limit;

turning on and turning off the switch according to the timing signal.

18. The method of claim 17, further comprising the steps of detecting the zero-crossing signal by comparing a first voltage of a first terminal of the switch to a second voltage of a second terminal of the switch;

edge detecting both the rising and falling edges of an output of the comparison;

whereby the detected edge signal is the zero-crossing signal.

19. The method of claim 17, wherein the duty-cycle is detected by a voltage detector monitoring an average voltage of at least one terminal of the switch; and wherein the reaching of the duty-cycle to the maximum limit is detected by a fall of the average voltage below a predetermined minimum limit.

20. The method of claim 17, further comprising the step of generating a blanking pulse to reduce the duty-cycle.

21. The method of claim 17, wherein the duty-cycle is generated by a method of voltage-fraction to duty-cycle conversion.

22. The method of claim 21, wherein the method of voltage-fraction to duty-cycle conversion is comprising the steps of:

generating a sawtooth signal;

detecting a peak voltage of the sawtooth signal;

dividing the peak voltage to a fraction;

comparing the fraction to the sawtooth signal;

whereby a signal with a duty-cycle equal to the fraction is generated.

23. The method of claim 22, wherein the peak voltage is detected by sample-and-hold of the sawtooth signal at the peak.

24. The method of claim 22, wherein division of the peak voltage is performed by a potentiometer.

25. The method of claim 17, further comprising the steps of:

detecting the presence of an inductive load through monitoring a voltage of at least one terminal of the switch;

switching between a leading edge and a trailing edge operation mode of dimming according to the detection of the inductive load.

26. The method of claim 25, wherein the method of inductive load detection is comprising the steps of:

detecting a voltage across the load as a first signal;

detecting a current through the load as a second signal;

phase shifting the first signal by 90 degrees as a third signal;

determining a phase difference between the second and the third signal;

whereby the phase difference is indicative of the inductive load.

27. The method of claim 26, wherein the phase difference is determined by the steps of:

comparing the second signal with a zero reference to generate a first digital signal;

comparing the third signal with the zero reference to generate a second digital signal;

performing logical exclusive-OR function on the first and the second digital signals for a third digital signal;

low-pass filtering the third digital signal for a DC signal;

whereby the DC signal is indicative of the phase difference.

28. The method of claim 25, wherein the detection of the inductive load is by the steps of:

high-pass filtering a first voltage of at least one terminal of the switch to a second voltage;

coupling the second voltage to a charge pump;

whereby a voltage at the output of the charge pump is indicative of the inductive load.

* * * * *